US005351502A

United States Patent [19]

Gilles et al.

[11] Patent Number: 5,351,502

[45] Date of Patent: Oct. 4, 1994

[54] COMBINATION ANCILLARY HEAT PUMP FOR PRODUCING DOMESTIC HOT H20 WITH MULTIMODAL DEHUMIDIFICATION APPARATUS

[75] Inventors: Theodore C. Gilles, Dallas; Robert B. Uselton, Lancaster, both of Tex.

[73] Assignee: Lennox Industries, Inc., Dallas, Tex.

[21] Appl. No.: 57,581

[22] Filed: May 4, 1993

Related U.S. Application Data

[63] Continuation of Ser. No. 912,819, Jul. 13, 1992, abandoned, which is a continuation-in-part of Ser. No. 785,049, Oct. 30, 1991, abandoned.

[51] Int. Cl.[5] ..... F25B 27/02; F25B 39/02

[52] U.S. Cl. ..... 62/238.7; 62/79; 62/434; 62/524

[58] Field of Search ..... 62/238.7, 238.6, 79, 62/430, 434, 515, 519, 524, 525

[56] References Cited

U.S. PATENT DOCUMENTS

| | | | |
|---|---|---|---|
| 1,801,371 | 4/1931 | Snader | 62/524 |
| 3,142,970 | 8/1964 | Hale | 62/524 |
| 3,371,501 | 3/1968 | Rhea et al. | 62/525 |
| 3,866,439 | 2/1975 | Bussjager et al. | 62/504 |
| 4,391,104 | 7/1983 | Wendsclag | 62/79 |
| 4,575,001 | 3/1986 | Oskarsson et al. | 237/2 B |

*Primary Examiner*—Henry A. Bennet
*Assistant Examiner*—William C. Doerrler
*Attorney, Agent, or Firm*—Allegretti & Witcoff

[57] ABSTRACT

The ancillary heat pump apparatus of the present invention for producing domestic hot water generally includes a domestic hot water heat pump having refrigerant and water circuits which are operatively disposed at the proximal ends thereof into close array at the heat exchanger of tile domestic hot water heat pump. The refrigerant circuit of the domestic hot water heat pump hereof has a heat exchanger coil disposed at the distal end thereof, and the water circuit is connected at the distal end thereof to a hot water heater. In the apparatus of the present invention, the distal refrigerant circuit heat exchanger coil is disposed into operative heat exchanging position, directly or indirectly, with a return fluid stream of a heat source. In combination therewith is a multimodal dehumidification apparatus providing a valve for defining flow through a selected portion of dehumidification coils.

26 Claims, 2 Drawing Sheets

A
220
222
216
218
218
210
212
214
B

A
220
222
218
216
212
214
B

COMBINATION ANCILLARY HEAT PUMP FOR PRODUCING DOMESTIC HOT H20 WITH MULTIMODAL DEHUMIDIFICATION APPARATUS

This application is a continuation-in-part application of Ser. No. 07/912,819, filed on Jul. 13, 1992, now abandoned which is a continuation in part of Ser. No. 07/785,049, filed on Oct. 30, 1991 and entitled "Ancillary Heat Pump Apparatus For Producing Domestic Hot Water" now abandoned the specification of which is incorporated by reference herein.

BACKGROUND OF THE INVENTION

The present combination invention relates in general to new, improved and more efficient apparatus for dehumidifying an air stream in conjunction with apparatus for simultaneously producing domestic hot water (hereinafter sometimes "DHW"), and more particularly to a combination ancillary heat pump (hereinafter sometimes "AHP") and multimodal evaporator coil system for such purpose.

In regard to domestic hot water production aspects of the present combination invention, experts within the electric utility industry have determined that the 1990 Federal Clean Air Act and other regulatory action may necessitate replacement of resistance electric heat water heating technology, due to the primary energy intensiveness of the operation of such technology. The Department of Energy report *The Potential for Electricity-Efficiency Improvements in the U.S. Residential Sector*, issued July, 1991, identifies the existing 22,000,000 residential electric hot water heaters as the largest single source of potential savings of electrical energy.

The above problems which are principally related to large levels of primary energy consumption have engendered the search for more energy efficient means of producing domestic hot water. Presently available systems for producing domestic hot water, include, inter alia, integrated and combined space conditioning and water heating heat pump apparatus, self-contained heat pump water heaters, desuperheaters and full condensers (some of which are provided as add-ons to condensing units), heat pipe dehumidification apparatus, and similarly related apparatus.

However, each of these presently available prior art methodologies has associated therewith one or more serious application and/or cost effectiveness problems. Some of the problems associated with the prior art are:

1. the necessity for protecting potable water lines from freezing with an add-on reclaim heat exchanger mounted within an outdoor (condensing) unit;
2. the major additional cost of providing a module with the compressor located indoors;
3. field modification of the refrigerant piping system; and
4. installation cost and application problems associated with dedicated heat pump hot water heaters.

In regard to dehumidification aspects of the present combination invention, air source heat pump water heaters can dehumidify the air inside a house, but such usages lower the operating efficiency. Moreover, such dehumidification is generally desireable in the summer but unnecessary in the winter. Accordingly, the dilemma is created as to whether this would be a greater benefit in optimizing the evaporator design for summer or winter.

in some preferred embodiments, a multi-speed blower could be used to change the heat pump water heater evaporating temperature, and thus the dehumidification capability of the system.

In view of the above difficulties, defects and deficiencies with prior art systems, it is a material object of the present invention to reduce significantly each of the above and other problems associated therewith.

It is a further object of the present invention to provide an ancillary heat pump and associated dehumidification system for production of domestic hot water wherein a preferably small and self-contained heat pump having a co-axial heat exchanger and compressor is disposed, in one preferred embodiment, with a heat exchanger coil thereof directly in the return air stream of a heat pump or of a heating and air conditioning system.

It is also an object of the present invention to provide means for injecting the associated cooling effect hereof directly into an accompanying heating and/or air conditioning system, rather than merely "dumping" such associated cooling effect into the space around the heater tank, while providing appropriate and efficient levels of dehumidification thereto.

It is also a further object of the present invention to provide apparatus wherein there is no necessity to pipe potable water into an outdoor environment, or, as an alternative, to repipe extensively the refrigeration circuit of the heat pump or condensing unit to an indoor heat exchanger location, but rather to keep the HVAC and hot water system refrigeration circuits totally isolated, so that there is no risk of water contaminating the HVAC refrigeration system in the event of a heat exchanger failure.

It is a yet further object of the present invention to provide hot water efficiently during the heating season regardless of the type of space heating fuel being used, and to provide appropriate and efficient levels of dehumidification thereto.

These and other objects of the ancillary heat pump and associated dehumidification apparatus for providing domestic hot water of the present invention will become more apparent to those skilled in the art upon review of the following summary of the invention, brief description of the drawing, detailed description of preferred embodiments, appended claims and accompanying drawing.

SUMMARY OF THE INVENTION

In preferred embodiments of the present combination invention, an evaporator with two stacked circuits is used to provide such dehumidification functioning to the present combination invention. In such embodiments, a valve is installed between a refrigerant expansion device and an upper evaporator circuit. When the device is operating, the lower circuit is always receiving refrigerant. The structure also functions to expose such lower circuit to one-half of the air flow. By closing the valve, all refrigerant is forced through the lower circuit. A lower evaporating temperature will result, as compared to operation with both circuits flowing. The lower evaporating temperature will cause more moisture removal from the airstream.

The ancillary heat pump and associated dehumidification apparatus of the present invention for producing domestic hot water generally also includes a domestic hot water heat pump having refrigerant and water circuits which are operatively disposed at the proximal ends thereof into close array at the heat exchanger of the domestic hot water heater pump. The refrigerant circuit of the domestic hot water heat pump hereof has a heat exchanger coil disposed at the distal end thereof, and the water circuit is connected at the distal end thereof to a hot water heater. In the apparatus of the present invention, the distal refrigerant circuit heat exchanger coil is disposed into operative heat exchanging position, directly or indirectly, with respect to a return fluid stream of a primary heat and/or cooling source. In preferred embodiments of the present invention, the heat source may be selected from the group consisting of (a) a space conditioning air stream heat pump, (b) a heating and/or air conditioning system, and (c) a hydronic distribution HVAC system. Other forms of a heat source may likewise be utilized.

The above described inventive structure of the ancillary heat pump apparatus of the present invention for producing domestic hot water includes, inter alia, the following desirable features:

1. does not require piping potable water to outdoor ambients;
2. applicable to any heat pump or air conditioning system, including those with space conditioning thermal energy storage (i.e., TES);
3. does not require special indoor compressor HVAC units;
4. totally separated from HVAC system refrigeration piping system;
5. better annual primary energy efficiency than fossil fuel hot water heaters;
6. could be applied with certain available hydronic indoor coil and oversized hot water tank for storage-based space heating load leveling operation; and
7. has a net present value of about $5,000, including space heating revenue benefit, to a typical electric utility.

The following important characteristics are also present in the ancillary heat pump apparatus of the present invention for producing domestic hot water:

1. In the cooling mode, hot water is supplied "free" without the expenditure of any additional kwh of electricity.
2. Hot water is supplied in the heating season with a COP of 1.70 or higher.
3. Hot water can supplied during mild seasons, without either heating or cooling demands, with a COP of 1.50 to 1.90.

The importance of conserving primary energy is demonstrated in the following analysis:

TABLE A

| | Summer | Winter | Annual |
|---|---|---|---|
| Daily hot water used (gallons) | 105 | 90 | |
| Temperature rise (degrees) | 60 | 75 | |
| Summer energy used (million Btu/year)(125 days) | 6.56 | — | |
| Winter energy used (million Btu/year)(240 days) | — | 13.49 | |
| Average net DHW COP | — | 1.75 | |
| Annual power required, kwh | — | — | 2260 |
| Total Annual hot water energy used (million Btu) | — | — | 20.10 |
| Energy efficiency @ 10500 Btu/kwh (utility heat rate) | — | — | 84.7% |

In comparison, the typical gas-fired water heater recovery efficiency of the prior art is in the range of 76 to 82%, while pilot and off-cycle vent losses reduce the annual efficiency to 65% or less.

The above comparative water heating annual costs are, as follows:

| | |
|---|---|
| Direct element electric heating (5890 kwh @ $0.04) | $236 |
| Gas @ 65% efficiency and $6/mcf | $186 |
| AHP combined inventive system (2,260 kwh @ $0.04) | $90 |

The annual difference of $146 between the direct element electric system and the combined direct hot water with associated ancillary heat pump (AHP) of the present invention would permit the expenditure of $876 additional installed cost (calculated at 10 year, 20% ROI) for the combined hot water heating system. Most importantly, however, the apparatus of the present invention provides a primary energy efficiency and cost effective competitive system which is highly beneficial to consumers and to the electric utilities. These estimates are conservative estimates since a COP of 1.75 has been used. However, an hour-by-hour annual analysis could result in a COP of up to 2.0 for most locations in the United States. Since the apparatus of the present invention will have no water heater gas pilot or off-cycle vent losses, it will improve the overall efficiency of a dwelling that uses gas for space heating, while providing "free" hot water from the air conditioning system.

The additional heat exchanger coil as used herein may require an air filter, but because it is a "dry" coil and may be designed with wide fin spacing (i.e., 8 fpi), such a filter may not be necessary in these embodiments. Moreover, the structure of the present invention can in certain embodiments be optimized as either a full cross-section or partial cross-section, with a bypass configuration to be installed anywhere on the return air side (including exhaust air stream or other unconditioned air stream) of any heating and/or air conditioning system, whether installed in connection with a split system heat pump, furnace and air conditioner or rooftop single package unit.

In addition to the foregoing features, appropriate dehumidification provided for seasonally efficient utilization is a beneficial functioning accomplished by the combination apparatus hereof, as described in greater detail, infra.

These and other aspects and features of the present invention may be better understood with regard to the following brief description of drawing, detailed description of preferred embodiments, appended claims and accompanying drawing.

BRIEF DESCRIPTION OF THE DRAWING

The present invention is set forth in the accompanying drawing, and in which.

DETAILED DESCRIPTION OF PREFERRED EMBODIMENTS

Figure 1:
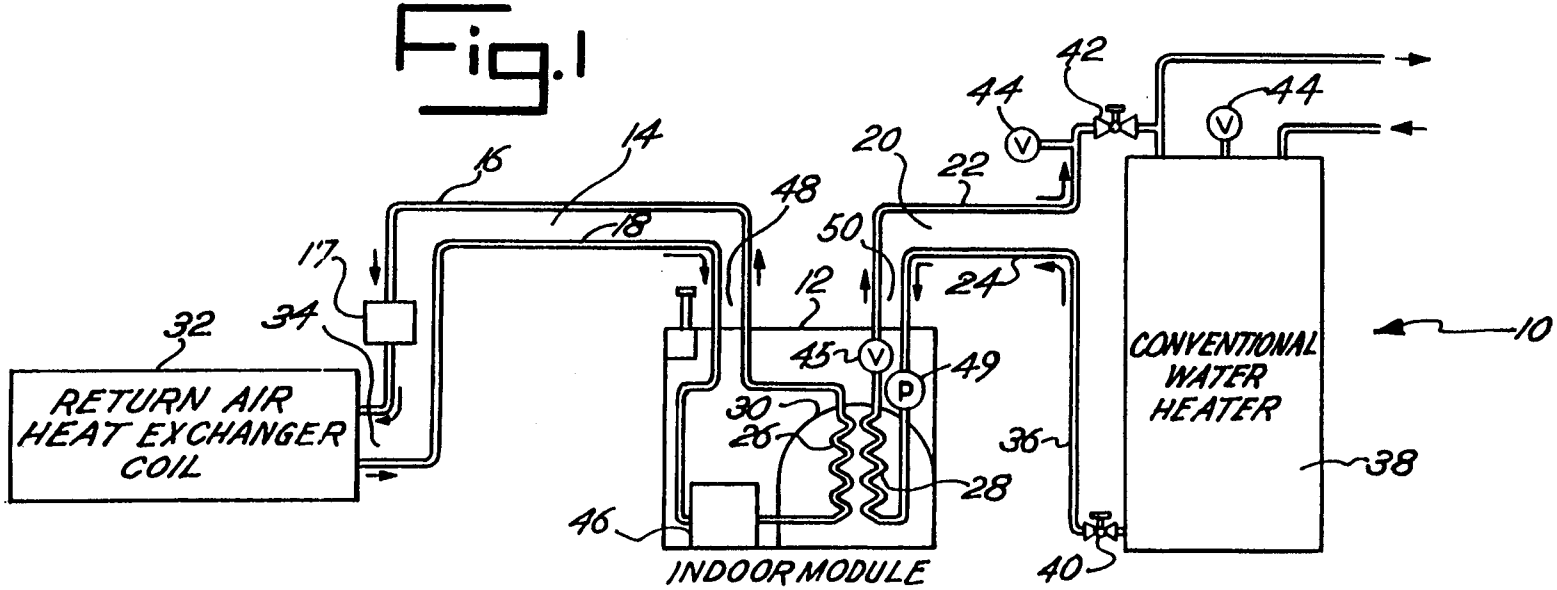
FIG. 1 is a schematic diagram of one embodiment of the ancillary heat pump apparatus of the present invention (without associated dehumidification apparatus) for production of domestic hot water, primarily for use as an indoor module, and illustrates a return fluid heat exchanger coil disposed at the distal end of the refrigeration circuit thereof and a conventional water heater disposed at the distal end of the water circuit thereof, and further shows a compressor and water circulating pump as a part of said heat pump.

One material aspect of the apparatus of the present invention for producing domestic hot water includes a heat pump dedicated to producing domestic hot water. This domestic hot water heat pump has a refrigerant circuit and a water circuit, which are each operatively disposed at the proximal ends thereof into mutual close array at the heat exchanger element of the domestic hot water heat pump. Each of the refrigerant circuit and the water circuit respectively includes influent and effluent portions. The refrigerant circuit has a heat exchanger coil at the distal end thereof. The water circuit is connected at the distal end thereof to a hot water storage tank, which may be conventional hot water heater.

Most fundamentally, in the apparatus of the present invention, the distal refrigerant circuit heat exchanger coil is disposed into operative heat exchanging position within a return fluid stream of a primary heat and/or cooling source. The heat source may be of several different types, and may be preferably selected from group consisting of (a) a space conditioning air stream heat pump, (b) a heating and air conditioning system, and (c) a hydronic distribution HVAC system, of known types.

The domestic hot water heat pump may more particularly include a compressor disposed on and downstream of the proximal end of the refrigerant circuit on the influent portion of the refrigerant circuit. The domestic hot water heat pump may further particularly include a water circulating pump disposed upstream of the proximal end of the water circuit and on the influent portion of the water circuit.

The fluid stream of the heat source utilized in association with the present invention may be, in preferred embodiments, a liquid circuit of a hydronic distribution HVAC system, or may constitute a heat source selected from the group consisting of (a) an airstream of a space conditioning heat pump, and (b) a heating and air conditioning system. In these embodiments, a dedicated heat source exchanger may be further provided.

The domestic hot water heat pump utilized in association with the present invention is disposed indoors, in some preferred embodiments. The return fluid stream comprises the unconditioned air stream returning to the space conditioning heat and/or cooling source.

The apparatus for producing domestic hot water of the present invention may also include in other preferred embodiments the disposition of the distal intermediary fluid circuit heat exchanger coil to receive heat indirectly from the heat source. In these and other preferred embodiments, a supplemental heat exchanger means may be provided for operative intermediary heat exchange between the distal intermediary fluid circuit heat exchanger coil and the return fluid stream of the heat source. Also, in these embodiments, a supplemental hot water heat exchanger means may be disposed inside a building enclosure, and the heat pump may be disposed outside of the building enclosure. Such a structure finds special utility in embodiments wherein R290 (propane) is utilized. The use of propane as a refrigerant, and in some embodiments in connection with glycol, as an intermediary fluid, permits material avoidance of the use of chloro- or fluoro-carbons, and is thus desirable based upon present perceptions of environmental damage believed to be caused by chloro-or fluoro-carbons.

In such indirect heat exchange embodiments, the heat exchanger means may comprise at least an upstream and a downstream heat exchanger, each of which includes heat input and heat output heat exchange coils. The downstream exchanger heat input coil is connected to a direct heat exchange coil disposed directly within the return fluid stream of the heat and/or cooling source.

Also, in such indirect heat exchange embodiments, the heat output coil of the downstream heat exchanger and the heat input coil of the upstream heat exchanger preferably contain a refrigerant which is substantially free of chloro- or fluoro-carbons. This refrigerant may comprise propane in preferred embodiments. Also in these embodiments, each of the direct heat exchanger coil and the refrigerant effluent line of the supplemental heat exchanger may likewise contain a intermediary fluid which is substantially free of chloro- or fluoro-carbons. This intermediary fluid may preferably comprise glycol, potassium acetate or other anti-freeze fluid and water.

Figure 2:
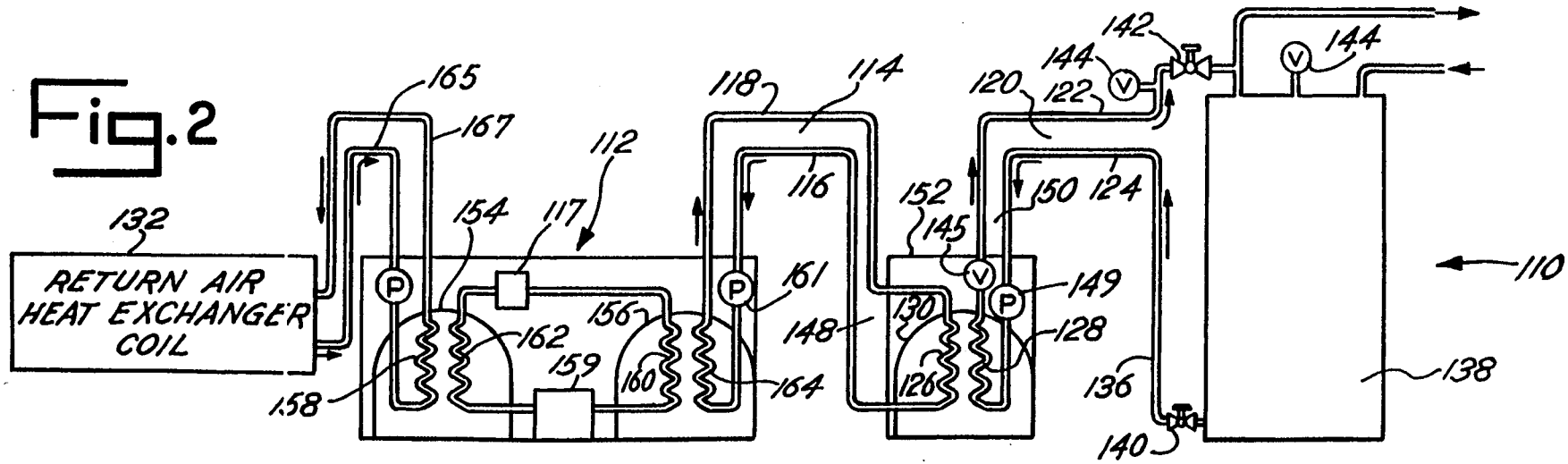
FIG. 2 is a schematic diagram showing an alternative embodiment, primarily for use as an outdoor module (without associated dehumidification apparatus) and thus for use with a non-halocarbon, particularly a non-chloro- or fluoro-carbon, and perhaps flammable refrigerant, such as R290 (propane)(rather than the typically used inflammable refrigerant such as R-22 or other hydrocarbon compounds), and showing the flammable refrigerant as disposed outside the occupied structure, and further showing two supplemental freeze resistant solution fluid circuits (such as glycol or potassium acetate with water) to communicate between the outdoor refrigeration module and the potable water heat exchanger, and thereby with the return fluid heat exchanger disposed within the occupied structure.

The above structures are depicted schematically in FIGS. 1 and 2 of the drawing of the present application, with FIG. 1 depicting an illustrative embodiment suitable for indoor use and FIG. 2 depicting an illustrative embodiment for outdoor use.

Referring now to FIG. 1, wherein diagrammatic symbols known to those skilled in the art are used, the apparatus generally 10 of the present invention for producing domestic hot water includes a heat pump 12 dedicated to producing domestic hot water. Domestic hot water heat pump 12 has a refrigerant circuit 14 comprising refrigerant effluent line 16 with refrigerant expansion device 17 and refrigerant influent line 18, and a water circuit 20 comprising hot water effluent line 22 and cold water influent line 24, which are each operatively disposed at the proximal ends 26,28 thereof into mutual close array at the heat exchanger clement 30 of domestic hot water heat pump 12. Refrigerant circuit 14 has a heat exchanger coil 32 at the distal end 34 thereof. Water circuit 20 is connected at the distal end 36 thereof to a hot water storage tank 38, which may be a conventional hot water heater. Suitable conventional valving, such as globe valves 40,42, and temperature pressure relief valve 44, water regulating valve 45, and other valves may be provided in connection with hot water heater 38.

Distal refrigerant circuit heat exchanger coil 32 is disposed into operative heat exchanging position within a return fluid stream of a heat source (not shown). Of course, the return air stream of a cooling only air conditioning system can be a heat source for the hot water heat pump. As indicated, supra, the heat source may be of several different types, and may be preferably selected from group consisting of (a) a space conditioning air stream heat pump, (b) a heating and/or air conditioning system, and (c) a hydronic distribution HVAC system, of known types.

Domestic hot water heat pump 12 may more particularly include a compressor 46 disposed on and downstream of the proximal end 48 of the refrigerant circuit on refrigerant influent line 18 of the refrigerant circuit 14. Domestic hot water heat pump 12 may further particularly include a water circulating pump 49 disposed upstream of the proximal end 50 of water circuit 20 and on the influent line 24 of water circuit 20.

Also with regard to the domestic hot water aspects of the present combination invention, and as shown in the alternative (outdoor module) embodiment of FIG. 2, elements common with the embodiment of FIG. 1 (indoor module) are indicted by use of reference numerals adding 100 to the designation set forth in FIG. 1. Thus, the apparatus generally 110 for producing domestic hot water of the present invention may also include in preferred embodiments the disposition of the distal intermediary fluid circuit heat exchanger coil 132 to receive heat indirectly from a heat source. As shown in FIG. 2, a supplemental heat exchanger means generally 152 may be provided for operative intermediary heat exchange between the distal intermediary fluid circuit heat exchanger coil 132 and the return fluid stream (not shown) of the heat source. Also in the embodiments of FIG. 2, domestic hot water heat pump 112 may be disposed outside a building enclosure and supplemental heat exchanger 152 may be disposed inside of the building enclosure. Such a structure finds special utility in embodiments wherein propane is utilized. The use of propane as a refrigerant, and some embodiments in connection with glycol, permits the material avoidance of the use of chloro-or fluoro-carbons, and is desirable based upon present perceptions of environmental damage caused by chloro-or fluoro-carbons, or other halocarbons.

In the domestic hot water production embodiments of FIG. 2, domestic hot water heat pump 112 comprises at least upstream and a downstream heat exchangers 154,156, which respectively include heat input exchange coils 158,160 and heat output heat exchange coils 162, 164. Domestic hot water heat pump 112 includes a compressor 159 with refrigerant expansion device 117 connecting heat exchangers 154,156, as well as a circulating pump 161, of known construction and functionality. Downstream exchanger heat input coil 158 is connected by means of heat transfer fluid influent and effluent lines 165,167 to direct heat exchange coil 132 disposed directly within the return fluid stream (not shown) of the heat source. Heat output coil 162 of downstream heat exchanger 154 and the heat input coil 160 of upstream heat exchanger 156 contain an intermediary refrigerant which is substantially free of chloro- or fluoro-carbons, and which refrigerant may comprise propane in preferred embodiments. Also in these embodiments of FIG. 2, each of domestic hot water heat pump 112 and direct heat exchanger coil 126 may contain a heat transfer fluid which is substantially free of chloro- or fluoro-carbons. This heat transfer fluid may preferably comprise glycol or other anti-freeze fluids.

Alternative embodiments of the present invention utilize a liquid hydronic circulating loop, which operates according to known methodology in various operational scenarios of hydronic HVAC systems embodiments, and in particular, with thermal energy storage, in at least the following modes:

a. direct mode,
b. charging storage mode,
c. discharging storage mode, and
d. mild season domestic hot water heating mode.

With hydronic HVAC systems, air ducts are replaced by hydronic lines. In some embodiments, such as hydronic heat pumps, refrigerant-to-water heat exchange may be utilized. Also, in such preferred embodiments, the refrigerant utilized may comprise a wide variety of refrigerant materials.

In view of the data set forth in the Examples hereof (see Examples II–V, infra,) it is determined that air source heat pump water heaters can dehumidify the air inside a house, but such usages lower the operating efficiency. Moreover, such dehumidification is generally desireable in the summer, but unnecessary in the winter. Accordingly, a choice is presented as to whether this would be a greater benefit in optimizing the evaporator design for summer or winter.

EXAMPLE I

With regard to the production of domestic hot water, one of the advantages of the improved heat pump water heater structure of the present invention is the superior theoretical source energy efficiency thereof. Utilization of the structure of the present invention has been shown to increase energy efficiency in the production of domestic hot water in connection with a variety of different forms of primary residential heating equipment. Table B, infra, and the sample calculations related thereto show that a conventional gas-fired domestic hot water heater has an annual efficiency of about 62% (1992 Federal Minimum Efficiency). If a desuperheater heat reclaim unit were to be used with the summer air conditioning unit, the annual primary source energy efficiency would be 92.1%. Those systems, however, have application limited to essentially tropical regions due to the risk of freezing up the potable water lines in the winter.

The heat pump water heater of the present invention with 78% or 95% AFUE gas-fired furnaces in a home and with various electric utility generating heat rates has primary (source) energy efficiencies ranging between 86.2 and 99.6%, as calculated below.

The annual efficiency of the heat pump water heater hereof in homes using a separate heat pump for space heating will be in the range of 85.3 to 92.5%, as calculated below.

TABLE B

| | Summer | Winter |
|---|---|---|
| Gal./day | 105 | 90 |
| Inlet temp. | 60 | 45 |
| Supply temp. | 120 | 120 |

TABLE B-continued

| Days | 120 | 240 |
|---|---|---|
| Q, $10^6$Btu | 6.56 | 13.49 |

| | |
|---|---|
| Gas water efficiency, % | 62 |
| Gas furnace 1, efficiency, % | 78 |
| Gas furnace 2, efficiency, % | 95 |
| Ancillary heat pump, C.O.P. | 4.00 |
| Ancillary heat pump C.O.P. with Heat Pump | 1.75 |
| Utility Heat Rate 1 | 10400 Btu/kWh |
| Utility Heat Rate 2 | 10000 Btu/kWh |
| Utility Heat Rate 3 | 9600 Btu/kwh |

| Domestic Hot Water | | Source Energy Efficiency | Site Gas $10^6$Btu |
|---|---|---|---|
| Gas heat and gas hot water heating | | 62.0 | 32.35[1] |
| Above with heat reclaimer | | 92.1 | 21.77[2] |
| Gas heat 1 and Ancillary heat pump | 10400 | 86.2 | 12.98[3] |
| | 10000 | 87.7 | 12.98 |
| | 9600 | 89.3 | 12.98 |
| Gas heat 2 and Ancillary heat pump | 10400 | 95.8 | 10.65[4] |
| | 10000 | 97.6 | 10.65 |
| | 9600 | 99.6[5] | 10.65 |
| Heat Pump and Ancillary heat pump @ | 10400 | 85.3[6] | |
| Heat Pump and Ancillary heat pump @ | 10000 | 88.8 | |
| Heat Pump and Ancillary heat pump @ | 9600 | 92.5 | |

[1]6.56/.62 10.58
13.49/.62 21.77
32.35
[2]13.49/.62 = 21.77
[3]13.49 − 13.49/4 = 10.12/.78 = 12.98
[4]10.12/.95 = 10.65
[5]13.49/4 × 1/3412 × 9600 = 9.49
10.65
20.14
100 × 20.05/20.14 = 99.6%
[6]13.49/1.75 × 1/3413 × 10400 = 23.49
100 × 20.05/23.49 = 85.3%

EXAMPLE II

The present improved combination ancillary heat pump for producing domestic hot water with multimodal dehumidification apparatus was further simulated, as described above, in two modes of operation. Initially, only one refrigeration circuit was used. Next, two refrigeration circuits were used—one circuit in the upper half of the coil and the other circuit in the lower half of the coil. The valve was used to limit flow only to the lower circuit or to allow parallel flow through both circuits, depending upon the conditions of testing.

Simulated testing was conducted utilizing computer programs similar in function and result to those utilized by the National Institute of Standards and Technology. In the first of such computer simulation(s), only one of the two circuits was active. This is the preferred mode of operation during the Summer months when greater dehumidification is required.

In summary, the coefficient of performance (COP) as calculated to be 2.667. As the sensible to total cooling ratio (Unit S/T) was 0.650, approximately 34% of cooling effect was from moisture removal.

Based upon an inlet water temperature of 105° F., and an indoor dry bulb (DB) temperature of 80° F. and an indoor wet bulb (WB) temperature of 67° F., which measures the air temperature going over the evaporator, and having a draw through the active coil of 300 CFM at 330 watts, a pump flow rate (FR) of 2.0 gallons per minute (8 PM) at 75 watts, and a compressor superheat ° F. (SH) at 20.0 and a compressor sub-cooling ° F. (SC) at 15.0, the following results were obtained:

| ID.DB | ID.WB | |
|---|---|---|
| 80.000 | 67.000 | |
| ID.CFM/Watts | Pump.FR/Watts | Comp. SH/SC |
| 300./330. | 2.00/75. | 20.0/15.0 |

Draw-Thru I.D.FAN
Result:

| | Temp. | Press | (enthalpy) H | X |
|---|---|---|---|---|
| Evap. In. | 42.2 | 71.7 | 42.36 | 0.235 |
| Evap. Out. | 53.6 | 65.8 | 110.70 | 1.000 |
| Suction | 57.5 | 64.8 | 111.42 | 1.000 |
| Discharge | 213.8 | 277.8 | 132.96 | 1.000 |
| Cond. In | 213.8 | 277.8 | 132.96 | 1.000 |
| Cond. Out | 109.8 | 277.8 | 42.36 | 0.000 |
| Sat.Suct. | Sat.Cond. | Liq.Sc. | Liq.T. | Flowrate |
| 37.5 | 125.0 | 15.2 | 109.8 | 118.1 |
| Capacity | Watts | COP | Comp.W. | |
| 10831. | 1190. | 2.667 | 785. | |

Water outlet temperature: 115.8
Unit S/T = 0.658
Leaving Air DB/WB = 66.16/59.78
Spec.Humidity In/Out = 0.01116/0.00947 (LB $H_2O$/LB Dry Air)
Evap.cap = 8073. BTUH (Gross) Coil S/T = 0.706

EXAMPLE III

In this Example, twice as much coil was utilized as in Example II, supra. More sensible cooling occurred with only 16% dehumidification (i.e., the Unit S/T ratio was 0.842). The coefficient of performance (COP) was 2.995, thus illustrating an increase in efficiency over the summer-time mode as set forth in Example II, supra. This is the mode which is utilized most efficiently when dehumidification is not needed.

| Indoor Dry Bulb | Indoor Wet Bulb | |
|---|---|---|
| 80.000 | 67.000 | |
| ID.CFM/Watts | Pump.FR/Watts | Comp. SH/SC |
| 600./330. | 2.00/75. | 20.0/15.0 |

Draw-Thru I.D.FAN
Result:

| | Temp. | Press | (enthalpy) H | X |
|---|---|---|---|---|
| Evap. In. | 50.1 | 84.2 | 43.36 | 0.225 |
| Evap. Out. | 65.6 | 82.0 | 111.90 | 1.000 |
| Suction | 68.1 | 80.8 | 112.41 | 1.000 |
| Discharge | 208.3 | 288.4 | 131.45 | 1.000 |
| Cond. In | 208.3 | 288.4 | 131.45 | 1.000 |
| Cond. Out | 112.9 | 288.4 | 43.36 | 0.000 |
| Sat.Suct. | Sat.Cond. | Liq.Sc. | Liq.T. | Flowrate |
| 48.1 | 127.8 | 14.9 | 112.9 | 143.2 |
| Capacity | Watts | COP | Comp.W. | |
| 12743. | 1247. | 2.995 | 842. | |

Water outlet temperature: 117.7
Unit S/T = 0.842
Leaving Air DB/WB = 68.84/62.60
Spec.Humidity In/Out = 0.01116/0.01067 (LB $H_2O$/LB Dry Air)
Evap.cap = 9816. BTUH (Gross) Coil S/T = 0.860

EXAMPLE IV

With an indoor wet bulb temperature of 55° F., and indoor dry bulb of 70° F., which are typical winter month indoor temperatures, a simulated example is run utilizing only one coil. The coefficient of performance (COP) is calculated to be 2.379, and the sensible to total cooling ratio (Unit S/T) is calculated to be 0.902. This is not a likely operation mode. The following data are calculated, as follows:

| Indoor Dry Bulb | Indoor Wet Bulb | |
|---|---|---|
| 70.000 | 55.000 | |
| ID.CFM/Watts | Pump.FR/Watts | Comp. SH/SC |
| 300./330. | 2.00/75. | 20.0/15.0 |
| Draw-Thru I.D.FAN | | |
| Result: | | |

| | Temp. | Press | (enthalpy) H | X |
|---|---|---|---|---|
| Evap. In. | 32.2 | 57.7 | 41.63 | 0.254 |
| Evap. Out. | 41.4 | 52.9 | 109.36 | 1.000 |
| Suction | 47.8 | 52.1 | 110.49 | 1.000 |
| Discharge | 221.3 | 268.9 | 134.81 | 1.000 |
| Cond. In | 221.3 | 268.9 | 134.81 | 1.000 |
| Cond. Out | 107.5 | 268.9 | 41.63 | 0.000 |
| Sat.Suct. | Sat.Cond. | Liq.Sc. | Liq.T. | Flowrate |
| 27.8 | 122.6 | 15.0 | 107.5 | 97.9 |
| Capacity | Watts | COP | Comp.W. | |
| 0252. | 1140. | 2.379 | 735. | |

Water outlet temperature: 114.2
Unit S/T = 0.902
Leaving Air DB/WB = 54.74/47.70
Spec.Humidity In/Out = 0.00576/0.00538 (LB $H_2O$/LB Dry Air)
Evap.cap = 6632. BTUH (Gross) Coil S/T = 0.919

EXAMPLE V

With an indoor wet bulb temperature of 55° F., and indoor dry bulb of 70° F., which are typical winter month indoor temperatures, a simulated example is run utilizing both coils. The coefficient of performance (COP) is calculated to be 2.711, and the sensible to total cooling ratio (Unit S/T) is calculated to be 1.000. This is the preferred heating season mode. The following data are calculated, as follows:

| Indoor Dry Bulb | Indoor Wet Bulb | |
|---|---|---|
| 70.000 | 55.000 | |
| ID.CFM/Watts | Pump.FR/Watts | Comp. SH/SC |
| 600./330. | 2.00/75. | 20.0/15.0 |
| Draw-Thru I.D.FAN | | |
| Result: | | |

| | Temp. | Press | (enthalpy) H | X |
|---|---|---|---|---|
| Evap. In. | 40.9 | 69.8 | 42.57 | 0.241 |
| Evap. Out. | 50.0 | 68.0 | 110.99 | 1.000 |
| Suction | 59.0 | 67.0 | 111.57 | 1.000 |
| Discharge | 212.8 | 279.2 | 132.71 | 1.000 |
| Cond. In | 212.8 | 279.2 | 132.71 | 1.000 |
| Cond. Out | 110.5 | 279.2 | 42.57 | 0.000 |
| Sat.Suct. | Sat.Cond. | Liq.Sc. | Liq.T. | Flowrate |
| 39.0 | 125.4 | 14.9 | 110.5 | 121.6 |
| Capacity | Watts | COP | Comp.W. | |
| 11085. | 1198. | 2.711 | 793. | |

Water outlet temperature: 116.1
Unit S/T = 1.000
Leaving Air DB/WB = 58.93/50.34
Spec.Humidity In/Out = 0.00576/0.00538 (LB $H_2O$/LB Dry Air)
Evap.cap = 8317. BTUH (Gross) Coil S/T = 1.000

In some preferred embodiments, a multi-speed blower could be used to change the heat pump water heater evaporating temperature, and thus the dehumidification capability of the system.

Figure 3:
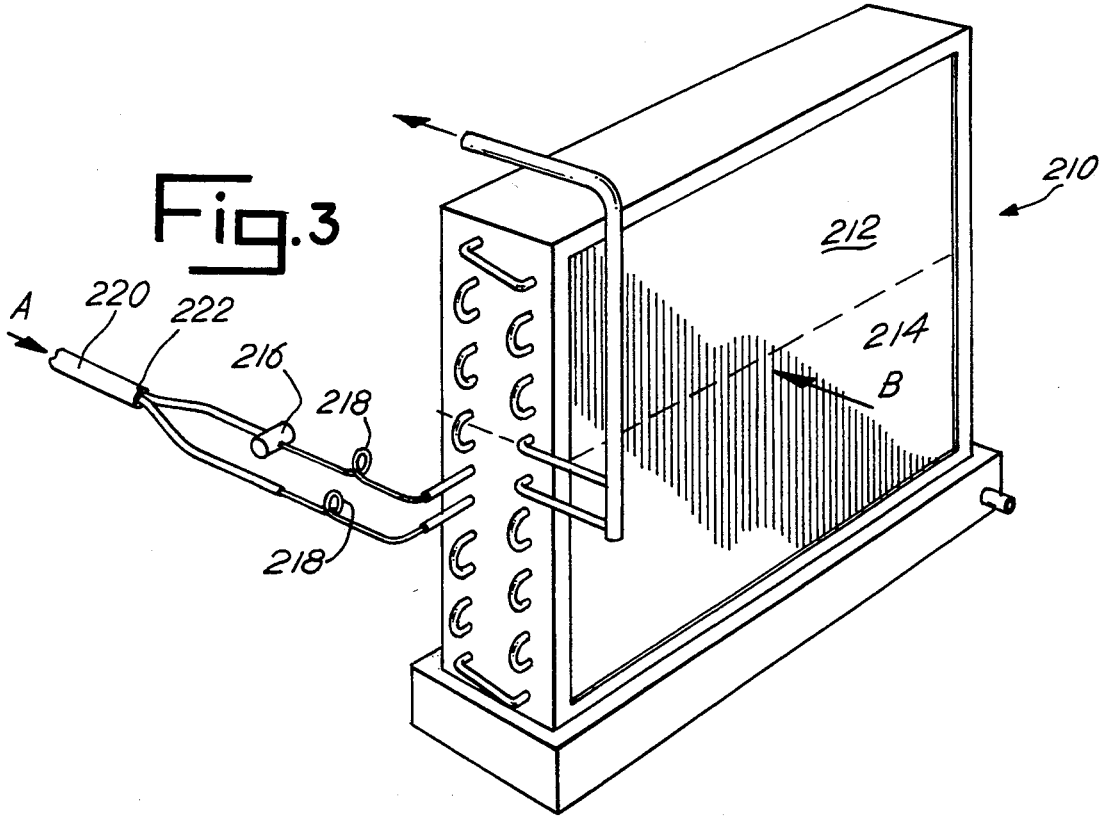
FIG. 3 is a partially schematic perspective view of the improved multimodal dehumidification apparatus portion of the present combination invention showing upper and lower fluid circuits with valve interconnecting the circuits to provide greater or lesser degrees of humidification as may be appropriate.
Figure 4:
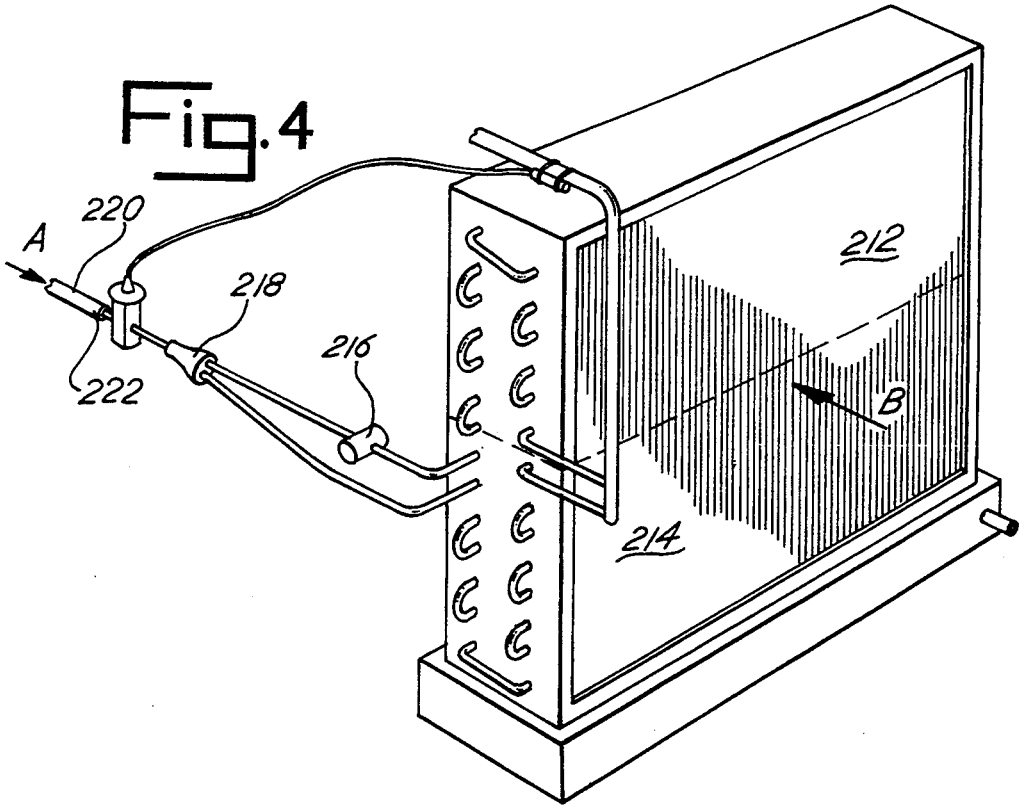
FIG. 4 is a partially schematic transverse cross-sectional view of the embodiment of FIG. 3 illustrating an exemplary flow pattern of fluid therethrough.

Referring now to FIGS. 3 and 4, an evaporator generally 210 with two stacked upper and lower circuits 212,214, is used to provide such dehumidification functioning to the present combination invention. In such embodiments, a valve 216 is installed between a refrigerant expansion device 218 and upper evaporator circuit 212. Of course, these component parts are well known to those of ordinary skill in the art, and hence various different forms of said parts may be selected for individual applications.

When the evaporator 210 is operating, lower circuit 214 is always receiving refrigerant 220, which is shown (at arrow A) entering conduit 222 upstream of refrigerant expansion device 218. Such lower circuit 214 is exposed to one-half of the air flow. By closing valve 216, all refrigerant 220 is forced through lower circuit 214. Hence, a lower evaporating temperature will result, as compared to operation with both circuits 212,214 having refrigerant 220 flowing therethrough. This lower evaporating temperature will cause more moisture removal from the airstream, generally depicted at Arrows B,B.

FIG. 4 sets forth the flow path for refrigerant 220 within upper and lower circuits 212,214, although other flow patterns could be utilized in alternative embodiments.

Table I, infra, sets forth one embodiment of tubes and other components comprising upper and lower circuits 212,214, although other formats are envisioned.

TABLE I

Coil Type - I
Coil Status - T
Coil Description - 2R.2CKT, 18 × 14, 14FPI
5/16. U Pattern
Created By - JLS
East Modified By JLS ON 04/01/
Number of Rows - 2
Number Tubes/Row - 14
Tube I.D. - 0.303
Tube O.D. - 0.327
Tube Centers - 1.00
Row Centers - 0.625
Dist. Between Endplts. - 18.00
Fins/Inch - 14.00
Fin Thickness - 0.0045
Fin Material - A
Tube Material - C
# of Repeating Sections - 1
Tubes for Row 1 to 5 - 14 14 0 0 0
Override - Y
Lanced Fins - __
Rifled Tubing - __
K Constant - 1.3610
Exponent - −0.4769
Tube #1 Offset - 0.250
Partial Row Offset - 0.000
Air Velocity Profile -

| | |
|---|---|
| 0.0 | 0.0 |
| 0.0 | 0.0 |
| 0.0 | 0.0 |
| 0.0 | 0.0 |
| 0.0 | 0.0 |
| 0.0 | 0.0 |
| 0.0 | 0.0 |
| 0.0 | 0.0 |
| 0.0 | 0.0 |
| 0.0 | 0.0 |

Internal Volume - 0.0229

The basic and novel characteristics of the improved apparatus of the present combination invention will be readily understood from the foregoing disclosure by those skilled in the art. It will become readily apparent that various changes and modifications may be made in the form, construction and arrangement of the improved apparatus of the present invention without departing from the spirit and scope of such inventions. Accordingly, the preferred and alternative embodiments of the present invention set forth hereinabove are not intended to limit such spirit and scope in any way.

What is claimed:

1. In combination, an apparatus for producing domestic hot water including a domestic hot water heat pump connected to a hot water storage tank, said domestic hot water heat pump having refrigerant and water circuits operatively disposed at the proximal ends thereof into close array exterior of said hot water storage tank at the heat exchanger of the domestic hot water heat pump, each of said refrigerant circuit and said water circuit respectively including influent and effluent portions, said refrigerant circuit having a heat exchanger coil at the distal end thereof, said water circuit connected at the distal and thereof to a hot water reservoir; said distal refrigerant circuit heat exchanger coil disposed into operative heat exchanging position with a return fluid stream selected from the group consisting of a primary heat source systematically separate from said heat pump and a primary cooling source systemically separate from said heat pump, and combined therewith a multimodal dehumidification apparatus for such domestic hot water heat pump system, said multimodal heat exchanger dehumidification apparatus comprising:

(a) an evaporator having a plurality of evaporator circuits disposed in spaced array, at least one said evaporator circuit continuously receiving refrigerant for flow therethrough to define continuously refrigerant receiving evaporator circuit(s), said evaporator circuits of said evaporator disposed within an air stream for condensative dehumidification thereof;

(b) valve means disposed in operative connection with at least one different of said evaporator circuits to define temporarily refrigerant receiving evaporator circuit(s) for providing refrigerant flow though at selected times and for requiring the refrigerant to flow through; and (c) whereby, by means of closing said valve, refrigerant is prevented from flowing through said temporarily refrigerant receiving evaporator circuit(s), and thus at said selected times flows only through said continuously refrigerant receiving evaporator circuit(s) to provide a reduced evaporating temperature as compared to operation with refrigerant flowing through both of said continuously and temporarily refrigerant receiving evaporator circuit(s), which causes an increased amount of water vapor to condense on said evaporator circuits to remove greater amounts of moisture from the air stream.

2. The combination of claim 1 wherein said heat source is selected from the group consisting of (a) a space conditioning air stream heat pump, (b) a heating and air conditioning system, and (c) a hydronic distribution HVAC system.

3. The combination of claim 1 wherein said domestic hot water heat pump includes a compressor disposed downstream said proximal end of said refrigerant circuit on said influent portion of said refrigerant circuit.

4. The combination of claim 1 wherein said domestic hot water heat pump includes a water circulating pump disposed on and upstream said proximal end of said water circuit and on said influent portion of said water circuit.

5. In combination, an apparatus for producing domestic hot water including a domestic hot water heat pump connected to a hot water storage tank, said domestic hot water heat pump having refrigerant and water circuits operatively disposed at the proximal ends thereof into close array at the heat exchanger of the domestic hot water heat pump, each of said refrigerant circuit and said water circuit respectively including influent and effluent portions, said refrigerant circuit having a heat exchanger coil at the distal end thereof, said water circuit connected at the distal end thereof to a hot water reservoir; said distal refrigerant circuit heat exchanger coil disposed into operative heat exchanging position with a return fluid stream of a heat and/or cooling source; and combined therewith a multimodal dehumidification apparatus for such domestic hot water heat pump system, said multimodal heat exchanger dehumidification apparatus comprising:

(a) an evaporator having a plurality of evaporator circuits disposed in spaced array, at least one said evaporator circuit continuously receiving refrigerant for flow therethrough to define continuously refrigerant receiving evaporator circuit(s), said evaporator circuits of said evaporator disposed within an air stream for condensative dehumidification thereof; and (b) valve means disposed in operative connection with at least one different of said evaporator circuits to define temporarily refrigerant receiving evaporator circuit(s) for providing refrigerant flow through at selected times and for requiring the refrigerant to flow through;

(c) whereby, by means for closing said valve, refrigerant is prevented from flowing through said temporarily refrigerant receiving evaporator circuit(s), and thus at said selected times flows only through said continuously refrigerant temperature as compared to operation with refrigerant flowing through both of said continuously and temporarily refrigerant receiving evaporator circuit(s), which causes an increased amount of water vapor to condense on said evaporator circuits to remove greater amounts of moisture from the air stream, and wherein said fluid stream of a heat source is a liquid circuit of a hydropic distribution HVAC system.

6. The combination of claim 5 further including a dedicated heat source heat exchanger.

7. The combination of claim 1 wherein said fluid stream of a heat source is selected from the group of (a) an air stream of a space conditioning heat pump, and (b) an air stream of a heating and/or air conditioning system.

8. The combination of claim 1 wherein said domestic hot water heat pump is disposed indoors.

9. The combination of claim 1 wherein said return fluid stream comprises the air stream returning to a space conditioning heat and/or cooling source.

10. The combination of claim 1 wherein said distal refrigerant circuit heat exchanger coil is disposed to receive direct contact by said return fluid stream of said heat source.

11. In combination, an apparatus for producing domestic hot water including a domestic hot water heat pump connected to a hot water storage tank, said domestic hot water heat pump having refrigerant and water circuits operatively disposed at the proximal ends thereof into close array at the heat exchanger of the domestic hot water heat pump, each of said refrigerant circuit and said water circuit respectively including influent and effluent portions, said refrigerant circuit having a heat exchanger coil at the distal end thereof, said water circuit connected at the distal end thereof to a hot water reservoir; said distal refrigerant circuit heat exchanger coil disposed into operative heat exchanging position with a return fluid stream of a heat and/or cooling source; and combined therewith a multimodal dehumidification apparatus for such domestic hot water heat pump system, said multimodal heat exchanger dehumidification apparatus comprising:

(a) an evaporator having a plurality of evaporator circuits disposed in spaced array, at least one said evaporator circuit continuously receiving refrigerant for flow therethrough to define continuously refrigerant receiving evaporator circuit(s), said evaporator circuits of said evaporator disposed within an air stream for condensative dehumidification thereof;

(b) valve means disposed in operative connection with at least one different of said evaporator circuits to define temporarily refrigerant receiving evaporator circuit(s) for providing refrigerant flow through at selected times and for requiring the refrigerant to flow through; and (c) whereby, by means for closing said valve, refrigerant is prevented from flowing through said temporarily refrigerant receiving evaporator circuit(s), and thus at said selected times flows only through said continuously refrigerant receiving evaporator circuit(s) to provide a reduced evaporating temperature as compared to operation with refrigerant flowing through both of said continuously and temporarily refrigerant receiving evaporator circuit(s), which causes an increased amount of water vapor to condense on said evaporator circuits to remove greater amounts of moisture from the air stream; and further comprising supplemental heat exchanger means for operative intermediary heat exchange disposed between said domestic hot water heat pump and said hot water storage tank.

12. The combination of claim 11 wherein said domestic hot water heat pump is disposed outside a building enclosure and said supplemental heat exchanger is disposed inside of said building enclosure.

13. The combination of claim 11 wherein said domestic hot water heat pump comprises at least upstream and downstream heat exchangers, each having heat input and heat output heat exchange coils, said downstream heat exchanger heat input coil which contains an intermediary fluid, connected to direct heat exchange coil disposed directly within said return fluid stream of said heat source.

14. The combination of claim 13 wherein said heat output coil of said downstream heat exchanger and said heat input coil of said upstream heat exchanger contain a refrigerant which is substantially free of halocarbons.

15. The combination of claim 14 wherein said refrigerant comprises a flammable heat exchange liquid.

16. The combination of claim 13 wherein said supplemental heat exchanger means has a heat input exchanger coil, and which contains an intermediary fluid which is substantially free of halocarbons.

17. The combination of claims 13 or 16 wherein said intermediary fluid is selected from the group consisting of (a) a solution of water and glycol, and (b) a solution of water and potassium acetate.

18. The combination of claim 15 wherein said flammable heat exchange liquid comprises propane.

19. An apparatus for producing domestic hot water including a domestic hot water heat pump connected to a hot water storage tank, said domestic hot water heat pump having refrigerant and potable water circuits operatively disposed at the proximal ends thereof into close array exterior of said hot water storage tank at the heat exchanger of the domestic hot water heat pump, said portable water circuit connected at the distal end thereof to a hot water reservoir, each of said refrigerant circuit and said potable water circuit respectively including influent and effluent portions, said refrigerant circuit having a heat exchanger coil at the distal end thereof, said potable water in said tank receiving heat for heating the potable water within said tank by means of heating a heat exchange portion of said potable water circuit at a location which is exterior of said hot water reservoir, said potable water circuit connected at the distal end thereof to a hot water reservoir;

said distal refrigerant circuit heat exchanger coil disposed into operative heat exchanging position with a return fluid stream selected from at least one of the group consisting of a primary heat source systematically separate from said heat pump and a primary cooling source systematically separate from said heat pump;

(a) an evaporator having a plurality of evaporator circuits disposed in spaced array, at least one said evaporator circuit continuously receiving refrigerant for flow therethrough to define continuously refrigerant receiving evaporator circuit(s), said evaporator circuits of said evaporator disposed within an air stream for condensative dehumidification thereof;

(b) valve means disposed in operative connection with at least one different of said evaporator circuits to define temporarily refrigerant receiving evaporator circuit(s) for providing refrigerant flow through at selected times and for requiring the refrigerant to flow through; and (c) whereby, by means of closing said valve, refrigerant is prevented from flowing through said temporarily refrigerant receiving evaporator circuit(s), and thus at said selected times flows only through said continuously refrigerant receiving evaporator circuit(s) to provide a reduced evaporating temperature as compared to operation with refrigerant flowing through both of said continuously and temporarily refrigerant receiving evaporator circuit(s), which causes an increased amount of water vapor to condense on said evaporator circuits to remove greater amounts of moisture from the air stream.

20. The improvement of claim 19 wherein said potable water circuit is directly connected to the potable water within said tank.

21. A retro-fit apparatus for producing domestic hot water including a domestic hot water heat pump having a heat exchanger and connected to a hot water storage tank, said domestic hot water heat pump having refrigerant and water circuits operatively disposed at the proximal ends thereof into close array at the heat exchange of the domestic hot water heat pump, each of said refrigerant circuit and said water circuit respectively including influent and effluent portions, said refrigerant circuit having a heat exchanger coil at the distal and thereof, said water circuit connected at the distal end thereof to a hot water reservoir;

said distal refrigerant circuit heat exchanger coil disposed into operative heat exchanging position with a return fluid stream selected from at least one of the group consisting of a pre-existing heat source systematically separate from said heat pump and a pre-existing cooling source systematically separate from said heat pump;

(a) an evaporator having a plurality of evaporator circuits disposed in spaced array, at least one said evaporator circuit continuously receiving refrigerant for flow therethrough to define continuously refrigerant receiving evaporator circuit(s), said evaporator circuits of said evaporator disposed within an air stream for condensative dehumidification thereof;

(b) valve means disposed in operative connection with at least one different of said evaporator circuits to define temporarily refrigerant receiving evaporator circuit(s) for providing refrigerant flow through at selected times and for requiring the refrigerant to flow through; and (c) whereby, by means of closing said valve, refrigerant is prevented from flowing through said temporarily refrigerant receiving evaporator circuit(s), and thus at said selected times flows only through said continuously refrigerant receiving evaporator circuit(s) to provide a reduced evaporating temperature as compared to operation with refrigerant flowing through both of said continuously and temporarily refrigerant receiving evaporator circuit(s), which causes an increased amount of water vapor to condense on said evaporator circuits to remove greater amounts of moisture from the air stream.

22. The combination of claim 1 wherein said valve means is disposed downstream a refrigerant expansion device.

23. The combination of claim 1 wherein said temporarily refrigerant receiving evaporator circuit(s) are disposed above said continuously refrigerant receiving evaporator circuit(s) in stacked array.

24. The combination of claim 1 wherein said temporarily and continuously refrigerant receiving evaporator circuit(s) include one each.

25. The combination of claim 1 wherein said temporarily and continuously receiving evaporator circuit(s) is supplied with refrigerant from a common feed conduit.

26. The combination of claim 1 wherein each of said temporarily and continuously refrigerant receiving evaporator circuit(s) supplies refrigerant vapor to a common refrigerant vapor effluent conduit.

* * * * *